US007654939B1

(12) United States Patent
Lin

(10) Patent No.: US 7,654,939 B1
(45) Date of Patent: Feb. 2, 2010

(54) TECHNIQUE PLATE FOR A BARBELL

(75) Inventor: Vincent Lin, No. 5, Lane 77, Meishan Rd., Niaosong Hsiang, Kaohsiung Hsien (TW)

(73) Assignees: Vincent Lin (TW); Tadamasa Uesaka (JP)

( * ) Notice: Subject to any disclaimer, the term of this patent is extended or adjusted under 35 U.S.C. 154(b) by 0 days.

(21) Appl. No.: 12/177,430

(22) Filed: Jul. 22, 2008

(51) Int. Cl.
*A63B 21/062* (2006.01)
*A63B 21/072* (2006.01)

(52) U.S. Cl. ..... 482/93; 482/106

(58) Field of Classification Search ..... 482/64, 482/65, 72, 106–109, 93; D21/680–682
See application file for complete search history.

(56) References Cited

U.S. PATENT DOCUMENTS 2,143,861 A * 1/1939 Clouse ..... 192/85 AA
D194,042 S * 11/1962 Guthormsen ..... D21/681
6,328,678 B1 * 12/2001 Romero ..... 482/106
6,440,044 B1 * 8/2002 Francis et al. ..... 482/114
7,229,391 B2 * 6/2007 Francis ..... 482/127
2001/0003110 A1 * 6/2001 Lay ..... 482/57

* cited by examiner

*Primary Examiner*—Loan H Thanh
*Assistant Examiner*—Allana Lewin
(74) *Attorney, Agent, or Firm*—Hershkovitz & Associates, LLC; Abraham Hershkovitz

(57) ABSTRACT

A technique plate in accordance with the present invention has a dimension ring, two clamping disks and a sleeve. The dimension ring has an internal edge, two side surfaces and a clamping protrusion. The clamping protrusion is formed on and protrudes from the internal surface. The clamping disks are mounted on and clamp the clamping protrusion of the dimension ring. Therefore, compared to a conventional technique plate of the same diameter, the technique plate of the present invention is lighter, so the distance between a bar of a barbell and the ground is higher to prevent beginner's injury.

18 Claims, 4 Drawing Sheets

TECHNIQUE PLATE FOR A BARBELL

BACKGROUND OF THE INVENTION

1. Field of the Invention

The present invention relates to a technique plate for a barbell, especially to be a technique plate that is suitable for a beginner to practice clean and jerk.

2. Description of the Prior Arts

A conventional barbell is used for weight training and competition and comprises a bar, at least two technique plates and two optional collars. The bar has two ends. The technique plates are selected from a variety of different weights and are evenly mounted respectively on the ends of the bar.

However, since plate weights and diameter are proportionally related, with a low weight bar, a distance between the bar of the conventional barbell and the ground is about 8 to 10 cm. The distance is not suitable for a beginner to practice clean and jerk. When the beginner squats and catches the bar of the barbell, the beginner's waist may be easily hurt.

To overcome the shortcomings, the present invention provides a technique plate to mitigate or obviate the aforementioned problems.

SUMMARY OF THE INVENTION

The main objective of the present invention is to provide a technique plate that is suitable for a beginner to practice clean and jerk.

A technique plate in accordance with the present invention has a dimension ring, two clamping disks and a sleeve. The dimension ring has an internal edge, two side surfaces and a clamping protrusion. The clamping protrusion is formed on and protrudes from the internal surface. The clamping disks are mounted on and clamp the clamping protrusion of the dimension ring. Therefore, compared to a conventional technique plate of the same diameter, the technique plate of the present invention is lighter, so the distance between a bar of a barbell and the ground is higher to prevent beginner's injury. Other objectives, advantages and novel features of the invention will become more apparent from the following detailed description when taken in conjunction with the accompanying drawings.

DETAILED DESCRIPTION OF THE PREFERRED EMBODIMENTS

Figure 1:
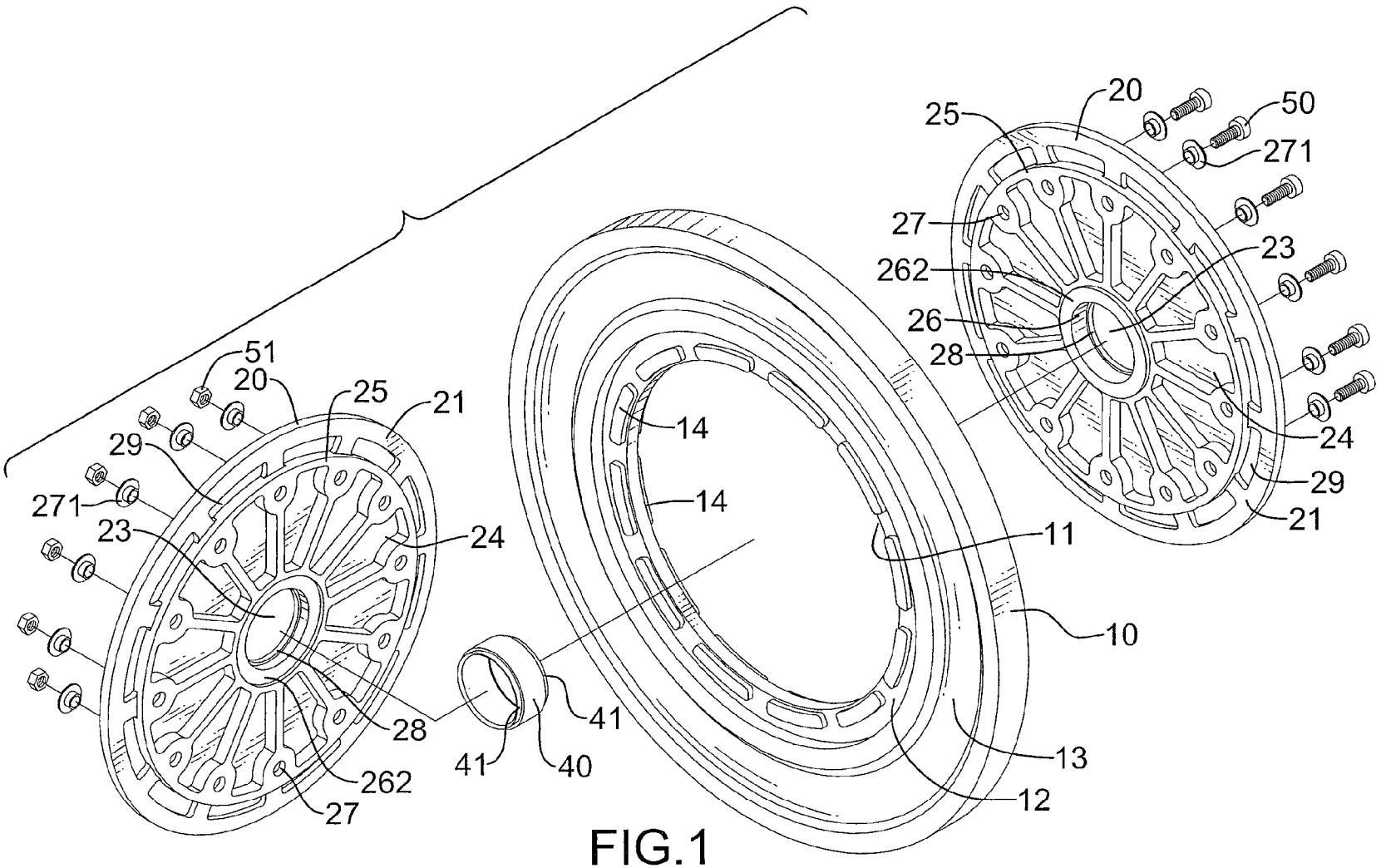
FIG. 1 is an exploded perspective view of a technique plate in accordance with the present invention.

With reference to FIG. 1, a technique plate for a barbell has a dimension ring (10), two clamping disks (20), a sleeve (40) and multiple fasteners (50, 51).

The dimension ring (10) may be rubber and has an external edge, internal edge, two side surfaces, a clamping protrusion (12) two optional annular troughs (13) and multiple protrusions (14). The dimension ring (10) may be plastic, rubber, metal or a combination thereof. The external edge has a standard thickness as prescribed by a corresponding international body, such as the International Weightlifting Federation or the like and a diameter that may be 40 centimeters. The clamping protrusion (12) is annular, is formed on and protrudes radially inwards from the internal edge of the dimension ring (10) and may be thinner than the dimension ring (10). The annular troughs (13) are defined respectively in the side surfaces between the internal and external edges of the dimension ring (10). The protrusions (14) are formed on and protrude form the clamping protrusion (12) of two surfaces of the dimension ring (10).

Figure 2:
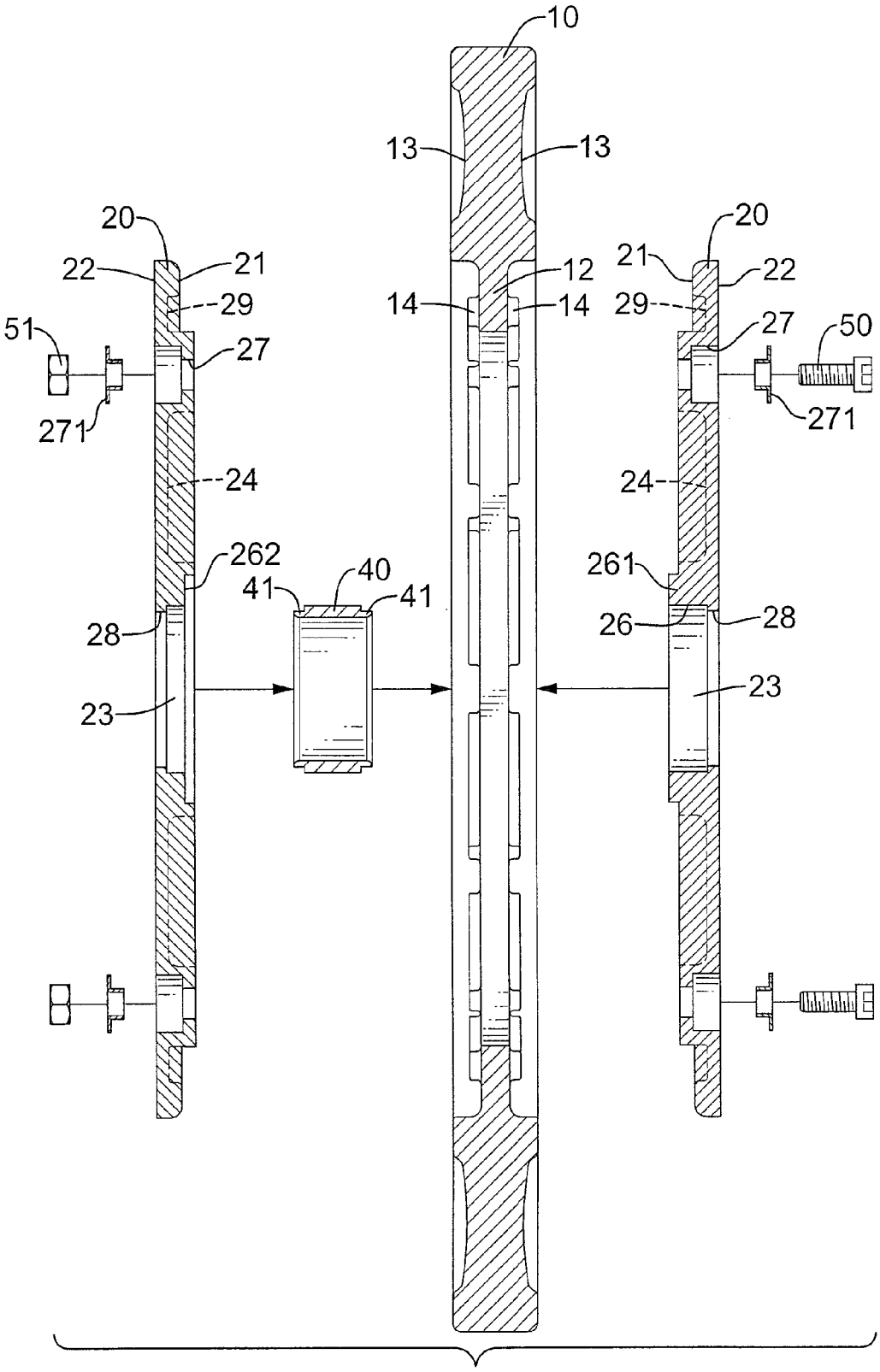
FIG. 2 is an exploded side view in partial section of the technique plate in FIG. 1.
Figure 3:
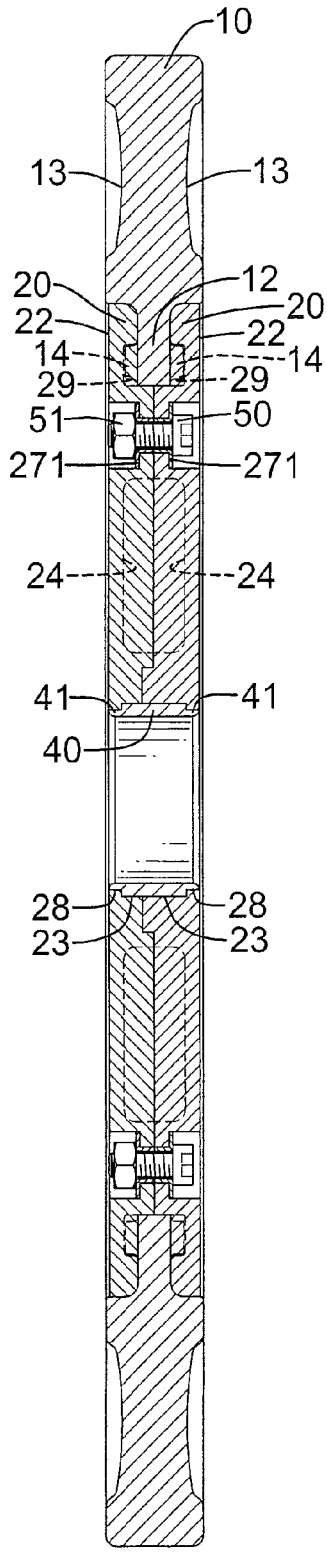
FIG. 3 is a side view in partial section of the technique plate in FIG. 1.

With further reference to FIGS. 2 and 3, the clamping disks (20) are mounted on and clamp the clamping protrusion (12) of the dimension ring (10) and have an inner surface (21), an outer surface (22), a hub (26), a through hole (23), a lip (28), a rim (25), multiple spokes (24), multiple fastener holes (27) and multiple elongated cavities (29). The hub (26) is formed on and protrudes from the inner surface (21) and is connected to the other hub (26). The hub (26) of one clamping disk (20) has a mounting protrusion (261) protruding axially from the hub (26). The hub (26) of the other clamping disk (20) has a mounting recess (262) defined axially in the hub (26) and receiving the mounting protrusion (261). The through hole (23) is formed centrally through the hub (26) and has an inner edge. The lip (28) is formed on and protrudes radially inwards from the inner edge of the through hole (23). The rim (25) is formed on and protrudes from the inner surface of the clamping disk (20). The spokes (24) are formed on and protrude radially from the inner surface (21) between the hub (26) and the rim (25) to strengthen the clamping disk (20). The fastener holes (27) are formed respectively through the spokes (24) adjacent to the rim (25) and may have countersinks respectively formed in the outer surface (22) of the clamping disk (20) and has a washer (271). The washer (271) is mounted on the fastener holes (27). The countersinks may be non-circular. The elongated cavities (29) are formed in the rim (25) and mounted on the protrusions (14) of the dimension ring (10).

The sleeve (40) is mounted securely in the through holes (23) of the clamping disks (20) and has two ends and two fitting recesses (41). The fitting recesses (41) are defined radially in the sleeve (40) adjacent respectively to the ends, correspond respectively to and respectively abut the lips (28) of the clamping disks (20).

The fasteners (50, 51) are mounted respectively through the fastener holes (27) and the washer (271) of the clamping disks (20) to protect the clamping disks (20). The fasteners (50, 51) may be nuts and bolts and the nuts and heads of the bolts may be disposed in the countersinks of the fastener holes (27). The nuts of the fasteners (50, 51) may correspond to the non-circular countersinks to prevent rotation.

Figure 4:
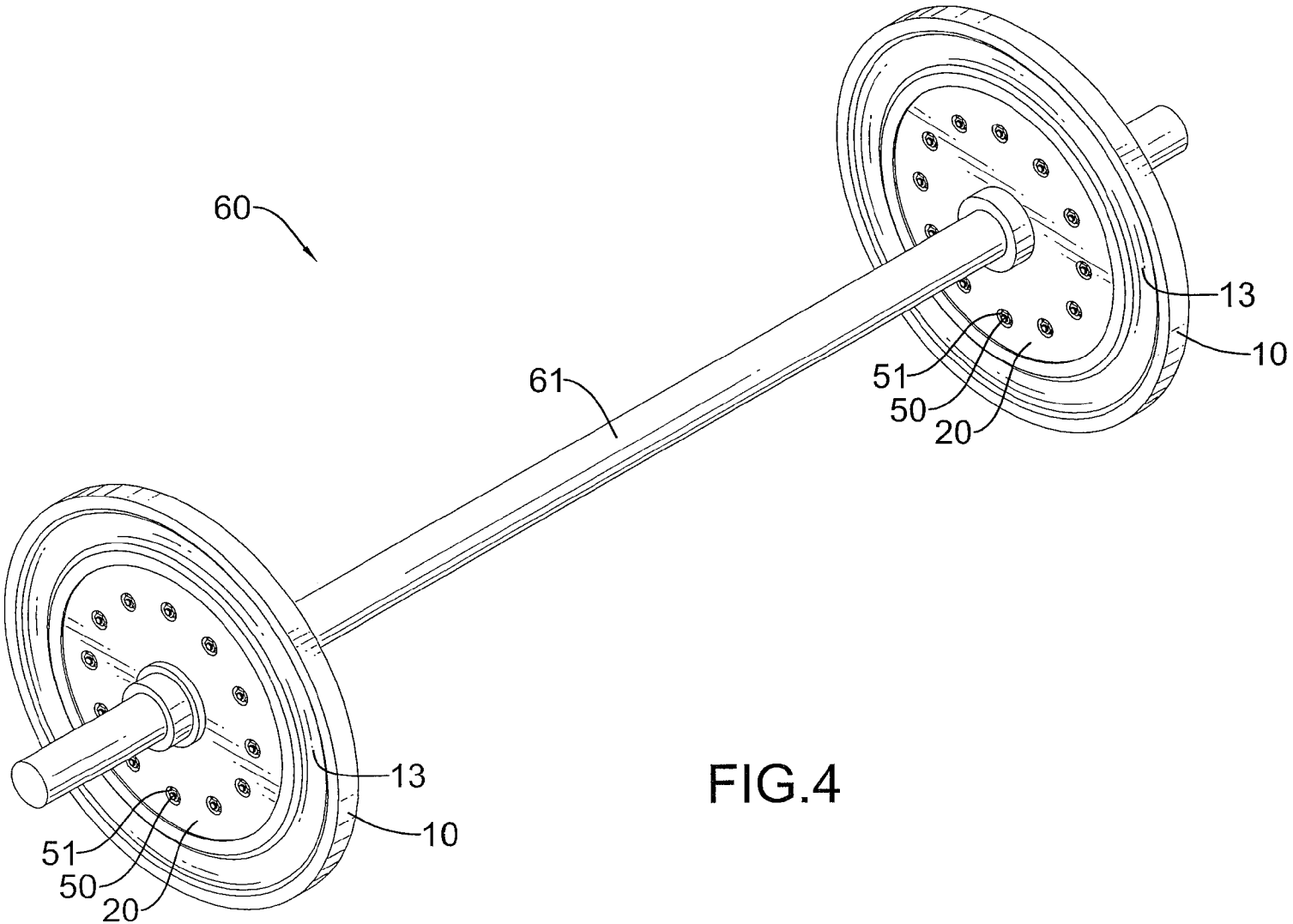
FIG. 4 is an operational perspective view of the technique plate in FIG. 1, shown mounted on a barbell.

With further reference to FIG. 4, multiple technique plates for barbells as described are used to adjustably weight a bar of a barbell. The bar (61) has two ends. The sleeves (40) of the technique plates are mounted on the ends of the bar. For a same diameter, the technique plate in accordance with the present invention is lighter than a conventional plate for a barbell. Therefore, a distance between the bar of the barbell and the ground is higher, so preventing a beginner's waist from being injured and teaches correct technique before adding excess weight.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A technique plate comprising a dimension ring having an external edge having a standard thickness and a diameter;

an internal edge;

two side surfaces; and a clamping protrusion being formed on and protruding radially inwards from the internal edge of the dimension ring;

two clamping disks being mounted on and clamping the clamping protrusion of the dimension ring, each clamping disk having an inner surface;

an outer surface;

a hub being formed on and protruding from the inner surface;

a through hole being formed centrally through the hub and having an inner edge;

a rim being formed on and protruding from the inner surface of each clamping disk;

multiple spokes being formed on and protruding radially from the inner surface between the hub and the rim; and multiple fastener holes being formed respectively through the spokes adjacent to rim;

a sleeve being mounted in the through holes of the first clamping disks; and multiple fasteners being mounted respectively through the fastener holes of the clamping disks.

2. The technique plate of as claimed in 1, wherein the clamping protrusion is thinner than the dimension ring.

3. The technique plate of as claimed in 2, wherein the dimension ring further has two annular troughs, each annular trough being defined respectively in the side surfaces and between the internal and external edges of the dimension ring.

4. The technique plate of as claimed in 1, wherein the dimension ring further has multiple protrusions being formed on and protrude form the clamping protrusion of two surfaces of the dimension ring;

the clamping disks further have multiple elongated cavities being formed in the rim and mounting on the protrusions of the dimension ring.

5. The technique plate of as claimed in 2, wherein the the dimension ring further has multiple protrusions being formed on and protrude form the clamping protrusion of two surfaces of the dimension ring;

the clamping disks further have multiple elongated cavities being formed in the rim and mounting on the protrusions of the dimension ring.

6. The technique plate of as claimed in 3, wherein the dimension ring further has multiple protrusions being formed on and protrude form the clamping protrusion of two surfaces of the dimension ring;

the clamping disks further have multiple elongated cavities being formed in the rim and mounting on the protrusions of the dimension ring.

7. The technique plate of as claimed in 1, wherein the clamping disks further have a lip being formed on and protruding radially inwards from the inner edge of the through hole; and the sleeve further has two ends and two fitting recesses being defined radially in the sleeve adjacent respectively to the ends, corresponding respectively to and respectively abutting the lips of the clamping disks.

8. The technique plate of as claimed in 2, wherein the clamping disks further have a lip being formed on and protruding radially inwards from the inner edge of the through hole; and the sleeve further has two ends and two fitting recesses being defined radially in the sleeve adjacent respectively to the ends, corresponding respectively to and respectively abutting the lips of the clamping disks.

9. The technique plate of as claimed in 3, wherein the clamping disks further have a lip being formed on and protruding radially inwards from the inner edge of the through hole; and the sleeve further has two ends and two fitting recesses being defined radially in the sleeve adjacent respectively to the ends, corresponding respectively to and respectively abutting the lips of the clamping disks.

10. The technique plate of as claimed in 4, wherein the clamping disks further have a lip being formed on and protruding radially inwards from the inner edge of the through hole; and the sleeve further has two ends and two fitting recesses being defined radially in the sleeve adjacent respectively to the ends, corresponding respectively to and respectively abutting the lips of the clamping disks.

11. The technique plate of as claimed in 5, wherein the clamping disks further have a lip being formed on and protruding radially inwards from the inner edge of the through hole; and the sleeve further has two ends and two fitting recesses being defined radially in the sleeve adjacent respectively to the ends, corresponding respectively to and respectively abutting the lips of the clamping disks.

12. The technique plate of as claimed in 6, wherein the clamping disks further have a lip being formed on and protruding radially inwards from the inner edge of the through hole; and the sleeve further has two ends and two fitting recesses being defined radially in the sleeve adjacent respectively to the ends, corresponding respectively to and respectively abutting the lips of the clamping disks.

13. The technique plate of as claimed in 7, wherein fastener holes further have a washer being mounted on the fastener holes.

14. The technique plate of as claimed in 8, wherein fastener holes further have a washer being mounted on the fastener holes.

15. The technique plate of as claimed in 9, wherein fastener holes further have a washer being mounted on the fastener holes.

16. The technique plate of as claimed in 10, wherein fastener holes further have a washer being mounted on the fastener holes.

17. The technique plate of as claimed in 11, wherein fastener holes further have a washer being mounted on the fastener holes.

18. The technique plate of as claimed in 12, wherein fastener holes further have a washer being mounted on the fastener holes.

* * * * *